US005282485A

United States Patent [19]

Hirai et al.

[11] Patent Number: 5,282,485

[45] Date of Patent: Feb. 1, 1994

[54] JET PICKLING APPARATUS

[75] Inventors: Etsuro Hirai; Keiji Tanizaki; Tadanori Miyamoto; Shoji Nagai, all of Hiroshima; Yoshinobu Nakane, Hyogo, all of Japan; Muneki Kita, Kuala Lumpur, Malaysia; Yoshinori Matsumoto; Kiyohiro Tani, both of Hyogo, Japan

[73] Assignee: Mitsubishi Jukogyo Kabushiki Kaisha, Tokyo, Japan

[21] Appl. No.: 821,152

[22] Filed: Jan. 16, 1992

[30] Foreign Application Priority Data

Jan. 16, 1991 [JP] Japan ..... 3-14954

[51] Int. Cl.[5] ..... B08B 3/02

[52] U.S. Cl. ..... 134/64 R; 134/122 R; 134/172; 134/199

[58] Field of Search ..... 232/103; 134/64 R, 122 R, 134/199, 172

[56] References Cited

U.S. PATENT DOCUMENTS 3,202,359 8/1965 Gill, Jr. ..... 239/103
3,687,145 8/1972 Schrader et al. ..... 134/122 R X
4,270,317 6/1981 Kurie ..... 51/426
4,415,143 11/1983 Ebata ..... 134/122 R X
4,700,890 10/1987 Hasegawa ..... 239/103
5,116,447 5/1992 Kimura et al. ..... 134/64 R X
5,118,357 6/1992 Sabatka ..... 134/122 R X

FOREIGN PATENT DOCUMENTS 1281567 12/1967 France ..... 239/103
88/01657 3/1988 World Int. Prop. O. .

*Primary Examiner*—Frankie L. Stinson
*Attorney, Agent, or Firm*—Jacobson, Price, Holman & Stern

[57] ABSTRACT

A jet pickling apparatus for pickling the surfaces of continuously moving sheet material (12) has tips of the nozzle headers (41–43) for discharging a pickling fluid (19) on the surfaces of the sheet and into a pickling tank (31) formed into a slit shape (41*a*–43*a*), and the nozzles (41,42) at the entrance side are installed to eject pickling fluid in the same direction as the running direction of sheet while the nozzle (43) at the exit side ejects the pickling fluid in the direction opposite to the running direction of the sheet. Therefore, there is no gas in the pickling tank (31) and the tank is filled with the pickling fluid (19), which eliminates the problems of floating of the sheet (12) and insufficient contact of the pickling fluid (19) with the sheet surfaces, allowing thorough pickling and improving the pickling effect.

6 Claims, 6 Drawing Sheets

JET PICKLING APPARATUS

BACKGROUND OF THE INVENTION AND RELATED ART STATEMENT

This invention relates to an apparatus for continuously moving sheet material by spraying pickling fluid on the sheet.

FIGS. 7 and 8 schematically show an apparatus for continuously pickling a sheet in accordance with the prior art.

As shown in these figures, a tank body 11 is box-shaped with its upper surface open, and has side walls 13 installed along both sides of tank body 11 in the running direction of conveyed sheet 12 (in the right and left direction in FIG. 7)

A tank bottom 14 of this tank body 11 is so constructed that its central portion in the width direction is one-step raised throughout the length of the tank body 11 in the running direction of the sheet 12. On the raised tank bottom 14 are arranged a plurality of skids 15 for supporting the sheet 12.

In the tank body 11, waste fluid passages 16, 16 are formed at both sides of the tank bottom 14 in the running direction of the sheet 12, and fluid collecting chambers 17, 17 are formed in front of and in rear of the tank body 11.

To the fluid collecting chambers 17, 17 are attached waste fluid pipes 18, 18, which are connected to an acid fluid tank 20 which stores pickling fluid 19.

Above the tank body 11, a cover 21 is disposed to close the tank body 11. The cover 21 is connected to the upper parts of the side walls 13.

An internal cover 23 is installed to the cover 21 via a plurality of support members 24 spaced in the running direction of the sheet 12, and has side walls 22 whose ends abut on the tank bottom 14.

In the vicinity of the lengthwise center is formed an opening in each of the side walls 22 of internal cover 23. These openings serve to connect the inner part of the tank body 11 defined by the internal cover 23 to the waste fluid passages 16.

Near the lengthwise ends of internal cover 23, a first nozzle header 26 is mounted at the entrance side of the sheet 12, and second nozzle headers 27, 28 are mounted at the exit side.

Each nozzle header 26, 27, 28 has a plurality of jet holes arranged in parallel, and is connected to the acid fluid tank 20 via a supply pipe 29, so that the pickling fluid 19 can be sprayed on the sheet 12 by means of an acid pump 30 connected in the supply pipe 29.

Thus, the pickling fluid 19 sprayed from the nozzle headers 26, 27, 28 is injected into a pickling tank 31 defined by the raised tank bottom 14 of the tank body 11, the internal cover 23, and the side walls 22. The sheet 12, while running in the pickling tank 31 by being supported by skids 15, is in contact with the pickling fluid 19, so that the upper and lower surfaces of the sheet are pickled.

In this process, the pickling fluid 19 sprayed from the nozzle headers 26, 27, 28 is collected in the pickling tank 31 by the jet pressure, and then flows in the waste fluid passages 16 through the openings 25 installed in the side walls 22, being directed to the fluid collecting chambers 17.

The pickling fluid collected in the fluid collecting chambers 17 is returned to the acid fluid tank 20 through waste fluid pipes 18.

When pickling of a sheet is performed by using the above-described apparatus according to the prior art, however, a uniform jet pressure cannot be applied in the direction of the pickling tank width because a plurality of jet holes on the nozzle header 26, 27, 28 are arranged in parallel, so that the pickling tank 31 is not sufficiently and sealingly filled with the pickling fluid 19; as a result, there arises low-pressure spaces which are not filled with pickling fluid. This presents the following problems: (1) the sheet 12 floats and comes in contact with the internal cover 23, causing the internal cover to be damaged, and (2) the pickling fluid 19 is not applied sufficiently to the upper surface of the sheet 12, producing a poor pickling effect.

BRIEF SUMMARY OF THE INVENTION

Accordingly, it is an object of this invention to provide a pickling apparatus which can apply sufficient pressure to the sheet by filling the pickling tank with pickling fluid sufficiently and sealingly with no gas spaces in the pickling tank, and can produce a satisfactory pickling effect.

To attain the above object, a jet pickling apparatus for pickling the surfaces of a sheet by the supply of pickling fluid is provided with, a pickling tank which is closed with a cover and through which the sheet is conveyed in its lengthwise direction, and pickling fluid supplying devices for supplying the pickling fluid at the sheet entrance and exit sides of the pickling tank, in which a pickling fluid supplying device mounted at least at the exit side of the pickling tank among the several pickling fluid supplying devices constitutes a nozzle having a slit-shaped discharge port extending throughout the exit width of the pickling tank, and the nozzle at the exit side injects the pickling fluid in the direction opposite to the running direction of the sheet.

As described above, the pickling fluid supplying device which is mounted at least at the exit side of the pickling tank among the several pickling fluid supplying devices constitutes a nozzle having a slit-shaped discharge port extending throughout the exit width of the pickling tank, and the nozzle at the exit side injects the pickling fluid in the direction opposite to the running direction of the hoop, by which the pickling fluid is prevented from flowing out from the pickling tank exit along with the travel of the hoop, and the filling of the pickling tank with pickling fluid eliminates the problems of the floating of the sheet and the insufficient contact of pickling fluid with the sheet surfaces, which allows thorough pickling and improves the pickling effect.

In a preferred configuration of this invention, it is preferable that the pickling fluid supplying device mounted at the entrance side of the pickling tank also constitutes a nozzle having a slit-shaped discharge port extending throughout the entrance width of the pickling tank, and the nozzle at the entrance side injects the pickling fluid in the same direction as the running direction of the sheet.

The above configuration provides an improved sealing effect of pickling fluid not only at the exit side but also at the entrance side, producing a satisfactory pickling effect.

Furthermore, in a preferred configuration of this invention, protectors are disposed in the vicinity of the pickling fluid discharge ports of the pickling fluid supplying devices at the exit and entrance sides to prevent the hoop from striking the discharge ports.

The use of protectors protects the nozzle discharge ports from breakage when the passing sheet is not flat but has a warp or undulation.

DETAILED DESCRIPTION OF PREFERRED EMBODIMENTS

Figure 1:
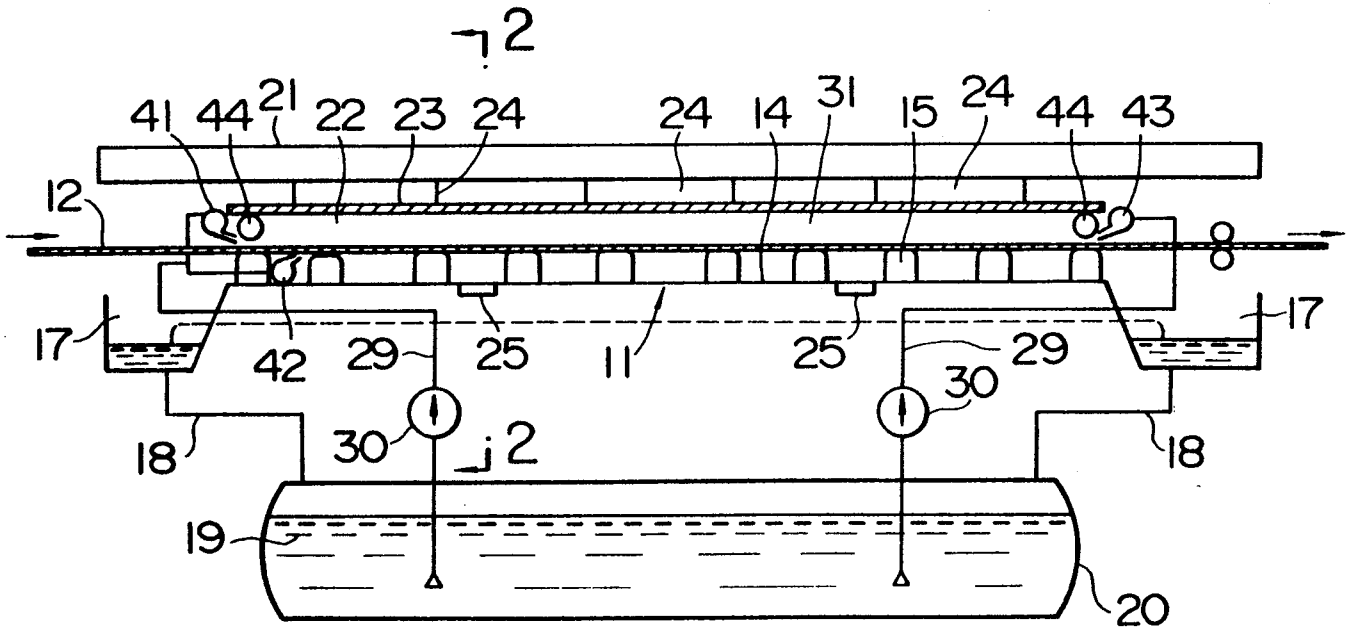
FIG. 1 is a schematic side elevational view of a jet pickling apparatus of an embodiment according to this invention.
Figure 2:
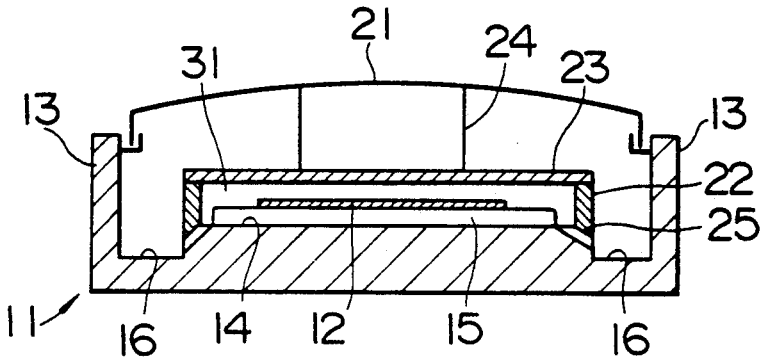
FIG. 2 is a cross sectional view taken along the plane of the line 2—2 of FIG. 1.

The preferred embodiments of this invention will now be described in detail with reference to the accompanying drawings.

Like reference numerals designate like or corresponding parts throughout the several drawings for avoiding duplication of explanation.

As shown in FIGS. 1 through 5, a tank body 11 of the jet pickling apparatus has side walls 13 along both sides of a sheet 12 conveyed horizontally. A tank bottom 14 of this tank body 11 is so constructed that its central part in the width direction is raised, and waste fluid passages 16, 16 are formed at both sides of the tank bottom 14 and fluid collecting chambers 17, 17 are formed in front of and in rear of the tank body 11.

Above the tank body 11, a cover 21 is disposed to close the tank body 11. The cover 21 is connected to the upper parts of the side walls 13. An internal cover 23 is installed to the cover 21 via a plurality of support members 24.

A pickling fluid 19 is injected into a pickling tank 31 defined by the raised tank bottom 14 of the tank body 11, the internal cover 23, and side walls 22.

Near the lengthwise ends of the internal cover 23, a first pair of pickling fluid supplying devices are vertically displaced so that upper nozzle header 41 is disposed in the air and lower nozzle header 42 is disposed in the fluid and are mounted at the entrance side of the hoop 12, and a further pickling fluid supplying device consists of an upper nozzle header 43 in the air mounted at the exit side.

Figure 3:
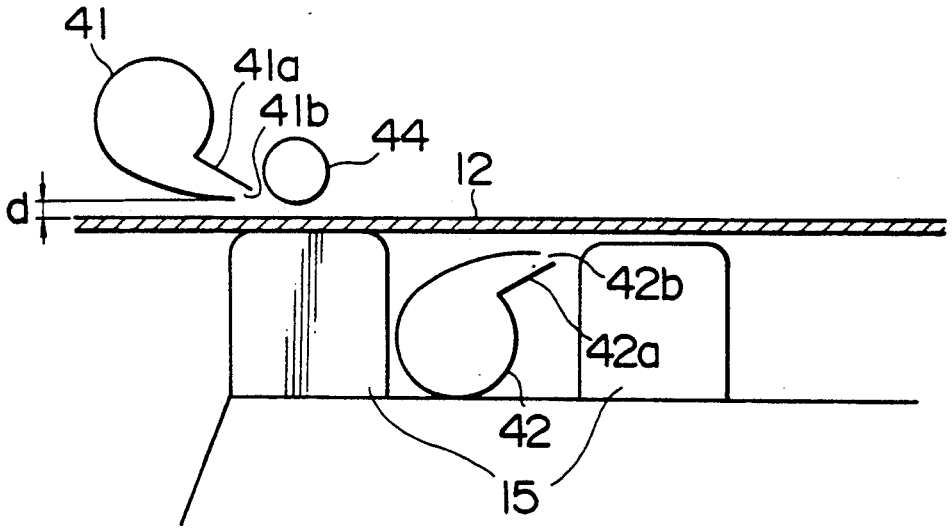
FIG. 3 is an enlarged schematic side view of a pickling fluid supplying device at the entrance side of the jet pickling apparatus of an embodiment according to this invention.

The nozzle headers 41, 42, 43, having nozzles 41*a*, 42*a*, 43*a*, respectively, each have a slit shape in the width direction of the sheet 12 (refer to FIG. 5), and are mounted in the following manner:

(1) For the vertical pair of nozzle headers 41, 42 at the entrance side for the first pickling fluid supplying means, the nozzles 41*a*, 42*a* are installed so that the pickling fluid is discharged in the same direction as the running direction of the sheet 12, and the angle at which the pickling fluid strikes the surface of the hoop 12 is adjusted for an acute angle (particularly less than 30°) (refer to FIG. 3).

Figure 4:
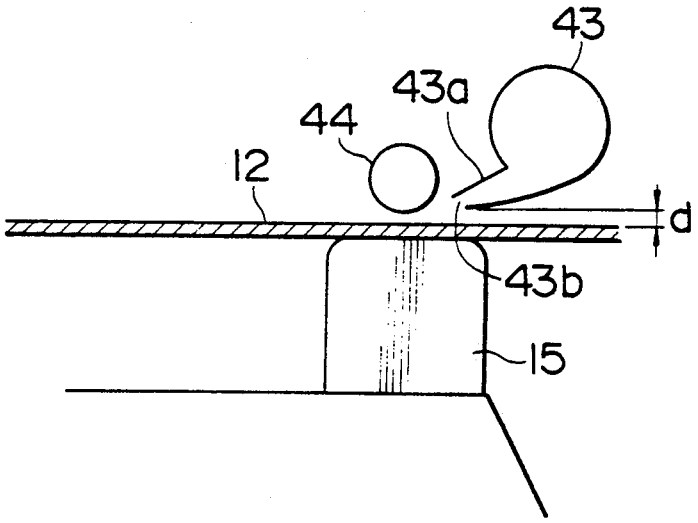
FIG. 4 is a similar to FIG. 3 view of a pickling fluid supplying device at the exit side of the jet pickling apparatus of an embodiment according to this invention.
Figure 5:
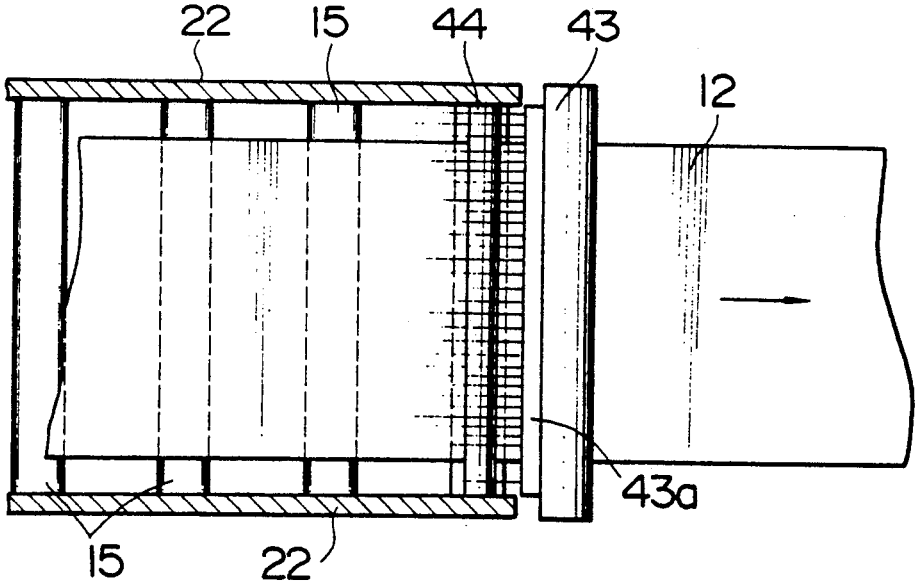
FIG. 5 is a schematic plan top view of a pickling fluid supplying device at the exit side of the jet pickling apparatus of an embodiment according to this invention.

(2) For the nozzle header 43 at the exit side for the second pickling fluid supplying device, the nozzle 43*a* is installed so that the pickling fluid is discharged in the direction opposite to the running direction of the sheet 12, and the angle at which the pickling fluid strikes the surface of the sheet 12 is adjusted for an acute angle (particularly less than 30°) (refer to FIG. 4).

The use of slit-shaped nozzles 41*a*–43*a* thus installed allow the pickling fluid 19 to be supplied continuously and uniformly in the width direction of pickling tank 31, which eliminates gas spaces and improves the sealing effect.

The slit-shaped nozzles 41*a*, 42*a* at the entrance side, because having an acute angle of discharged fluid, serve not only as a supplying means of the pickling fluid 19 but also as a liquid seal, allowing the pickling fluid to be supplied smoothly along the sheet 12.

The slit-shaped nozzle 43*a* at the exit side serves as a liquid seal together with a protector 44. Since the fluid discharge direction is opposite to the running direction of the sheet 12 and the discharge angle is acute, the momentum of the discharged pickling fluid 19 has the most effective sealing action.

Figure 6:
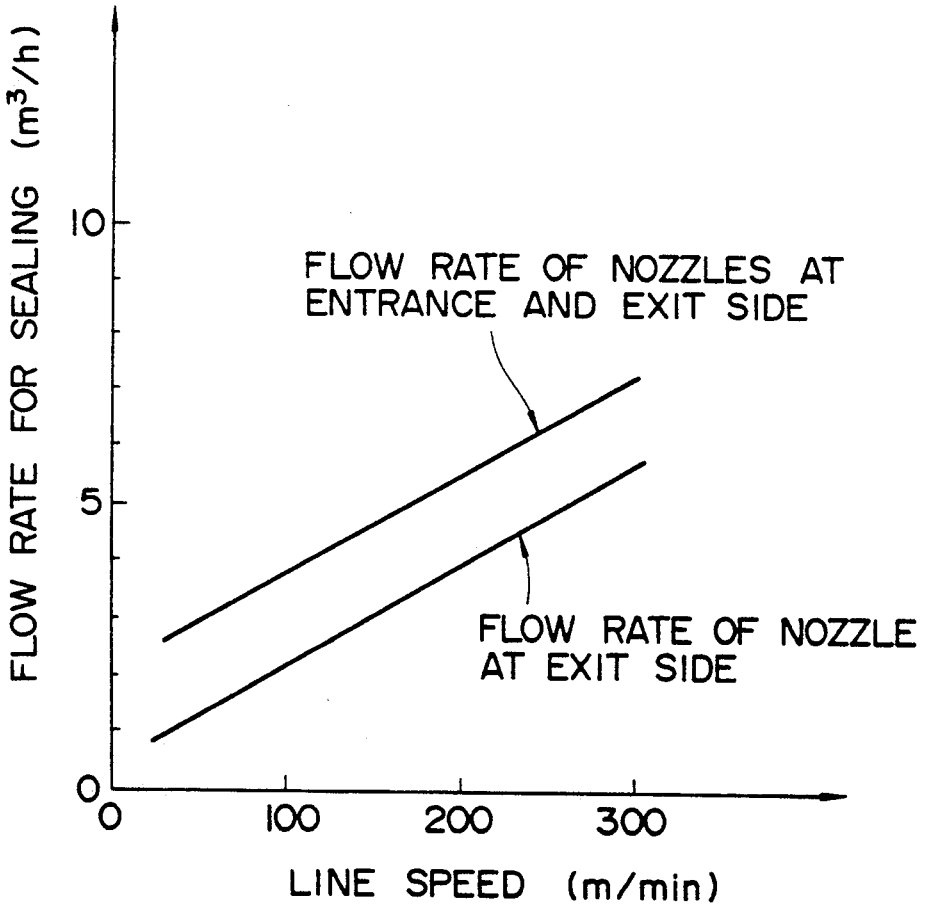
FIG. 6 is a graph showing the relationship between the flow rate of pickling fluid and the line speed of the sheet.
Figure 7:
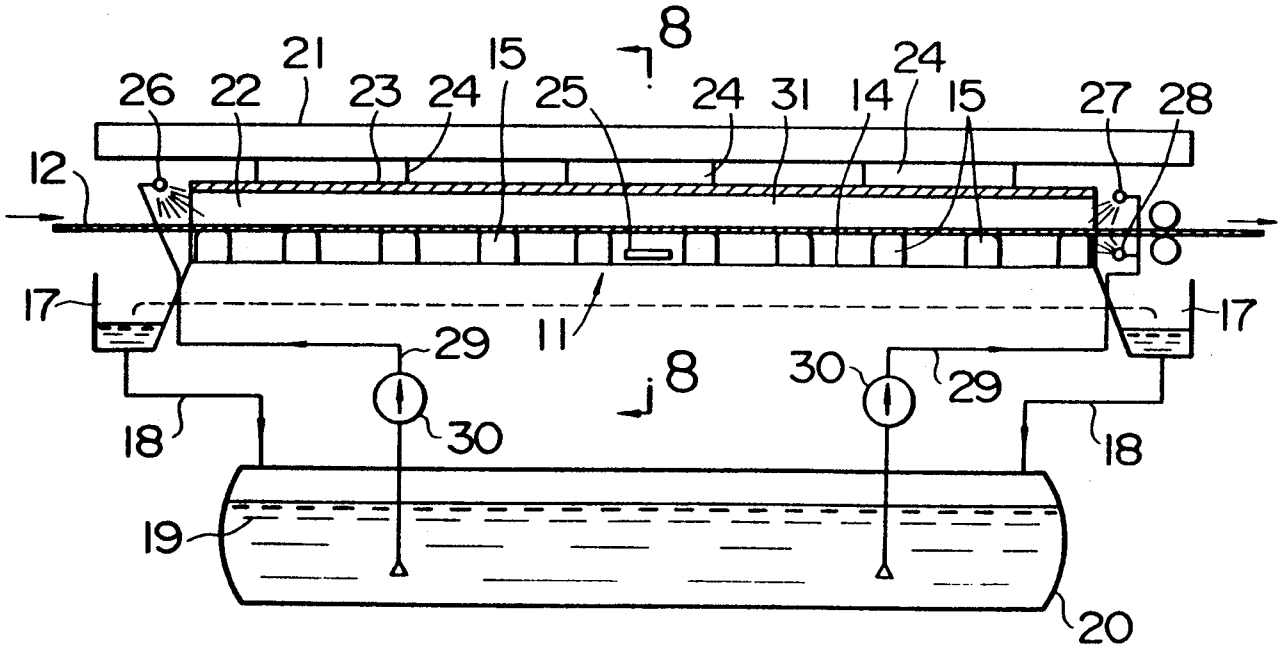
FIG. 7 PRIOR ART
FIG. 7 is a schematic side elevational view of a jet pickling apparatus according to the prior art.
Figure 8:
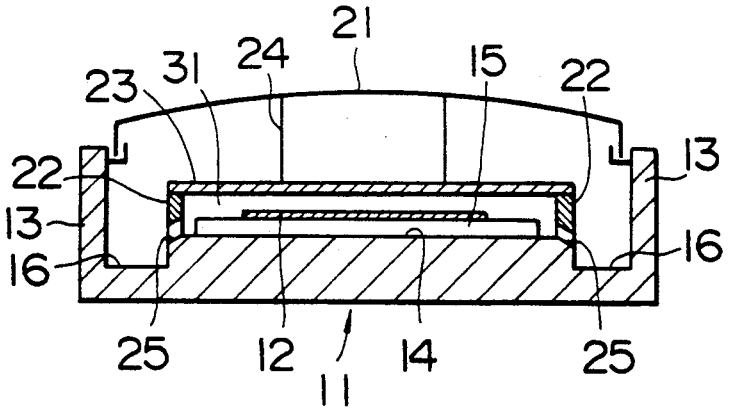
FIG. 8 PRIOR ART
FIG. 8 is a cross sectional view taken along the plane of the line 8—8 of FIG. 7.

FIG. 6 shows the relationship between the flow rate ($m^3/h$) of the pickling fluid 19 that can seal the pickling tank 31 and the line speed (m/min) of the sheet 12 for this embodiment, in which the distance d between the nozzle discharge port 41*b*, 42*b*, 43*b* and the sheet 12 is taken as 30 mm and the discharge velocity of pickling fluid is 4–8 m/s.

In the vicinity of the discharge port 41*b*, 43*b* of the slit-shaped nozzle of the nozzle header 41, 43 is rotatively mounted a discharge port protector roll 44, 44 to protect the nozzle discharge port 41*b*, 43*b* from breakage when the passing sheet 12 is not flat but has a warped portion or undulation (refer to FIGS. 3 and 4).

A protector skid can be used in place of the protector roll 44 to prevent breakage of the nozzle.

As described above, in the jet pickling device according to this invention, comprising a vertically displaced pair of nozzle headers 41, 42 having slit-shaped nozzles 41*a*, 42*a* at the entrance side as a pickling fluid supplying means for supplying the pickling fluid 19 injected into the pickling tank 31 which are installed in the same direction as the running direction of the sheet 12 and in such a manner that the discharge angle is acute (less than 30°), the liquid sealing ability at the entrance side is improved and the generation of gas spaces is prevented because the pickling fluid 19 is uniformly distributed in the pickling tank 31.

The liquid sealing ability is also improved because the nozzle header 43 having a slit-shaped nozzle 43*a* is installed at the exit side in the direction opposite to the running direction of the sheet 12 and in such a manner that the discharge angle of pickling fluid is acute (less than 30°). Therefore, the pickling fluid 19 is uniformly distributed in the pickling tank 31, which eliminates gas spaces and prevents the sheet 12 from floating. This allows thorough pickling of the sheet 12.

We claim:

1. A jet pickling apparatus for pickling surfaces of a sheet with pickling fluid, comprising:

a pickling tank having a cover for closing said tank, an entrance end, an exit end, and a length and width, said sheet being conveyed in the lengthwise direction through said tank and said entrance and exit ends thereof;

pickling fluid supplying means for supplying said pickling fluid at said entrance and exit ends of said pickling tank;

said pickling fluid supplying means at least at said exit end comprising a nozzle mounted on said tank and a slit-shaped discharge port in said nozzle extending throughout the width of said tank at said exit end for ejecting said pickling fluid in the direction substantially opposite to the conveying direction of said sheet; and protector means mounted on said tank in the vicinity of said discharge port for preventing said sheet from striking said discharge port, wherein:

said sheet is conveyed in a substantially horizontal direction; and said protector means comprises a substantially cylindrical roller mounted on said tank at the upper side of said sheet in spaced relationship thereto adjacent said discharge port, so that said roller cooperates with said nozzle to provide a liquid seal at said exit end for sealing against outflow of said pickling fluid through said exit end, and maintaining said tank substantially full of said pickling fluid.

2. The jet pickling apparatus as claimed in claim 1, wherein:

said nozzle at said entrance end of said tank is disposed adjacent the upper side of said sheet and ejects pickling fluid onto said upper side of said sheet;

a further nozzle is mounted on said tank at said entrance end adjacent the lower side of said sheet; and a slit-shaped discharge port is provided in said further nozzle extending throughout the width of said tank for ejecting pickling fluid substantially in the same direction as said conveying direction onto the lower side of said sheet.

3. The jet pickling apparatus as claimed in claim 1 wherein:

said discharge port is positioned in said nozzle for ejecting said pickling fluid at an angle less than 30° to the conveying direction of said sheet.

4. A jet pickling apparatus for pickling surfaces of a sheet with pickling fluid, comprising:

a pickling tank having a cover for closing said tank, an entrance end, an exit end, and a length and width, said sheet being conveyed in the lengthwise direction through said tank and said entrance and exit ends thereof; pickling fluid supplying means for supplying said pickling fluid at said entrance and exit ends of said pickling tank;

said pickling fluid supplying means at least at said exit end comprising a nozzle mounted on said tank and a slit-shaped discharge port in said nozzle extending throughout the width of said tank at said exit end for ejecting said pickling fluid in the direction substantially opposite to the conveying direction of said sheet;

said pickling fluid supplying means at said entrance end of said tank comprising a nozzle mounted on said tank and a slit-shaped discharge port in said nozzle extending throughout the width of said tank at said entrance end for ejecting said pickling fluid in substantially the same direction as said conveying direction of said sheet; and protector means mounted on said tank in the vicinity of said discharge ports for preventing said sheet from striking said discharge ports; wherein:

said sheet is conveyed in a substantially horizontal direction; and said protector means comprises a substantially cylindrical roller mounted on said tank at the upper side of said sheet in spaced relationship thereto adjacent each of said nozzles, so that said rollers are between said nozzles on said upper side of said sheet and cooperate with said nozzles to provide a liquid seal at said entrance and exit ends for sealing against outflow of said pickling fluid through said entrance and exit ends, and maintaining said tank substantially full of said pickling fluid.

5. The jet apparatus as claimed in claim 4 wherein:

said discharge ports are positioned in said nozzles so that each nozzle ejects pickling fluid at an angle less than 30° with respect to said sheet.

6. A jet pickling apparatus for pickling surfaces of a sheet with pickling fluid, comprising:

a pickling tank having a cover for closing said tank, an entrance end, an exit end, and a length and width, said sheet being conveyed in the lengthwise direction through said tank and said entrance and exit ends thereof;

pickling fluid supplying means for supplying said pickling fluid at said entrance and exit ends of said pickling tank;

said pickling fluid supplying means at least at said exit end comprising a nozzle mounted on said tank and a slit-shaped discharge port in said nozzle extending throughout the width of said tank at said exit end for ejecting said pickling fluid in the direction substantially opposite to the conveying direction of said sheet;

said pickling fluid supplying means at said entrance end of said tank comprises a nozzle mounted on said tank and a slit-shaped discharge port in said nozzle extending throughout the width of said tank at said entrance end for ejecting said pickling fluid in substantially the same direction as said conveying direction of said sheet; and protector means mounted on said tank in the vicinity of said discharge ports for preventing said sheet from striking said discharge ports; wherein;

said sheet is conveyed in a substantially horizontal direction;

said nozzle at said entrance end of said tank is disposed adjacent the upper side of said sheet and ejects pickling fluid onto said upper side of said sheet;

a further nozzle is mounted on said tank at said entrance end adjacent the lower side of said sheet;

a slit-shaped discharge port is provided in said further nozzle extending throughout the width of said tank for ejecting pickling fluid substantially in the same direction as said conveying direction onto the lower side of said sheet; and said protector means comprises a substantially cylindrical roller mounted on said tank at the upper side of said sheet in spaced relationship thereto adjacent each of said nozzles, so that said rollers are between said nozzles on said upper side of said sheet and cooperate with said nozzles to provide a liquid seal at said entrance and exit ends for sealing against outflow of said pickling fluid through said entrance and exit ends, and maintaining said tank substantially full of said pickling fluid.

* * * * *